US007385521B2

(12) United States Patent
Macari

(10) Patent No.: US 7,385,521 B2
(45) Date of Patent: Jun. 10, 2008

(54) TAMPER INDICATION DEVICE

(75) Inventor: Jason Macari, Lincoln, RI (US)

(73) Assignee: Ideaz, LLC, Glastonbury, CT (US)

( * ) Notice: Subject to any disclaimer, the term of this patent is extended or adjusted under 35 U.S.C. 154(b) by 120 days.

(21) Appl. No.: 11/145,013

(22) Filed: Jun. 3, 2005

(65) Prior Publication Data

US 2006/0061471 A1 Mar. 23, 2006

Related U.S. Application Data

(60) Provisional application No. 60/577,272, filed on Jun. 3, 2004.

(51) Int. Cl.
*G08B 21/00* (2006.01)
*G08B 13/14* (2006.01)

(52) U.S. Cl. ..... 340/686.6; 340/546; 340/570; 340/568.1; 340/686.1

(58) Field of Classification Search ..... 340/686.6, 340/546, 570
See application file for complete search history.

(56) References Cited

U.S. PATENT DOCUMENTS 3,797,006 A * 3/1974 Reininger ..... 340/530
3,842,410 A * 10/1974 Gopperton ..... 340/545.2
3,959,790 A 5/1976 Schuyler
4,002,397 A 1/1977 Wang et al.
4,009,474 A 2/1977 Eller
4,059,299 A * 11/1977 Huntley ..... 292/294
4,075,617 A 2/1978 Wireman
4,097,843 A 6/1978 Basile
4,157,542 A 6/1979 Smith
4,176,347 A 11/1979 McIntyre
4,189,723 A 2/1980 Hylton
4,203,622 A 5/1980 Cook et al.
4,391,204 A 7/1983 Mitchell et al.
4,438,428 A * 3/1984 Ober et al. ..... 340/521
4,465,997 A 8/1984 Hines
4,631,528 A * 12/1986 Handel et al. ..... 340/545.7
4,688,023 A 8/1987 McGill et al.
4,912,456 A 3/1990 Mickel
4,935,725 A 6/1990 Turnau
4,980,672 A 12/1990 Murphy
5,072,212 A * 12/1991 Sorenson ..... 340/546
5,139,319 A * 8/1992 Miyai et al. ..... 312/7.1
5,243,325 A 9/1993 Marin et al.
5,421,600 A 6/1995 Jones et al.
5,451,930 A 9/1995 McDaniel
5,469,139 A 11/1995 Ko
5,479,152 A 12/1995 Walker et al.
5,525,965 A 6/1996 Liebenthal
5,568,123 A * 10/1996 Derheim ..... 340/545.2
5,663,711 A 9/1997 Sanders et al.
5,714,942 A 2/1998 Buchanan
5,757,269 A 5/1998 Roth et al.
5,841,356 A 11/1998 Woodruff et al.
6,108,178 A 8/2000 Beadles
7,154,394 B2 * 12/2006 Zhou ..... 340/568.8

* cited by examiner

*Primary Examiner*—Donnie L Crosland
(74) *Attorney, Agent, or Firm*—Breiner & Breiner, LLC

(57) ABSTRACT

A tamper indication device includes a first component, a second component, and an alarm device. The alarm device indicates relative displacement of the first component and the second component. The alarm device includes an alarm circuit that detects the relative displacement and generates an alarm signal, and an alarm indicator that receives the alarm signal and generates an alarm indication.

52 Claims, 4 Drawing Sheets

TAMPER INDICATION DEVICE

FIELD OF THE INVENTION

The invention relates to access-control devices, particularly those used to prohibit access to children. More particularly, the invention related to access-control devices that include an indication that the access control has been defeated.

BACKGROUND OF THE INVENTION

The typical household can present many potential hazards for small children. Some of these hazards take the form of necessary fixtures placed close to the floor, such as electrical outlets. Others, such as refrigerators and other appliances with airtight or locking doors, can trap or suffocate a curious child. Dangerous objects around the house can be stored in drawers or cabinets, but children often manage to reach and inspect the contents of any storage space.

Conventional electrical outlet covers provide protection, but can be pried off by a child, which exposes the child to an additional choking hazard. Cabinets and appliances can be locked, but this presents an inconvenience to adults, who must have a key or combination in order to gain access. Less burdensome devices can be used to present an obstacle for a child. However, if these devices are defeated by a child, a long period of time might pass before a parent or other adult notices, during which time a child might be injured. For example, and older child might consider the locking device itself to be a challenge, having no interest in the danger that has its access restricted, and would be satisfied in removing the device. A younger child who is unimpeded by the device might then get hurt while removal of the device goes unnoticed.

BRIEF SUMMARY OF THE INVENTION

According to an aspect of the invention, a tamper indication device includes a first component, a second component, and an alarm device. The alarm device indicates relative displacement of the first component and the second component. The alarm device can include an alarm circuit that detects the relative displacement and generates an alarm signal, and an alarm indicator that receives the alarm signal and generates an alarm indication. For example, the alarm indicator can be an audio speaker. The tamper indication device can also include an actuator that sets the alarm device. For example, the actuator can include a switch, such as a typical switch having a first position and a second position. In such an embodiment, the actuator can set the alarm device when the switch is moved to the first position, and the alarm indicator can indicate an alarm when the switch is moved from the first position to the second position after the alarm device has been set. The actuator can include a latch.

The alarm device can include a delay device that delays the setting of the alarm device by a fixed time period following actuation of the alarm device by the actuator. For example, the delay device can be a circuit that senses actuation of the alarm device by the actuator and delays the setting of the alarm device by the fixed time period, which can be adjustable. The tamper indication device can also include an alarm suppression device that prevents the setting of the alarm device if actuated during the fixed time period.

According to a particular embodiment, the first component of the tamper indication device is an electrical socket base, and the second component is an electrical outlet socket cover. The electrical outlet socket cover can include at least one prong that engages a receptacle of the electrical socket. The alarm device or the actuator, or both, can be disposed within the electrical outlet socket cover. The switch is moved to the first position when the electrical outlet socket cover is disposed against the electrical socket base, and the switch is moved to the second position when the electrical outlet socket cover is moved away from the electrical socket base.

According to another embodiment, the first component of the tamper indication device is a blocking device attached to a first side of a sliding door, and the second component is a knob attached to a second side of a sliding door, opposite the blocking device. The blocking device can include a housing and a block within the housing that is movable between a first block position and a second block position. For example, the block can be attached to the housing along an axis such that the block is rotatable about the axis between the first block position and the second block position. In this example, the block prevents the sliding door from opening when the block is in the first block position, and the block allows the sliding door to open when the block is in the second block position. Similarly, the knob is rotatable between a first knob position and a second knob position. The disposition of the knob in the first knob position causes the block to be disposed in the first block position, and disposition of the knob in the second knob position causes the block to be disposed in the second knob position. For example, the knob can include a first magnet and the block can include a second magnet, and the relative positions of the first and second magnets can control whether the block is disposed in the first or second block position. The alarm circuit can be disposed in the blocking device housing, and can include a switch, for example, of the type that is movable between a first switch position and a second switch position. For example, the alarm circuit can generate the alarm signal when the switch is disposed in the second switch position, and can continuously generate the alarm signal after the switch has been disposed in the second switch position. The block can cause the switch to be disposed in the second switch position when the block is disposed in the second block position. The blocking device can also include a bar that is slidable between a first bar position and a second bar position. Such a bar, for example, can allow the block to be moved to the second block position when the bar is disposed in the first bar position, and can prevent the block from being moved to the second block position when the bar is disposed in the second bar position.

According to another embodiment, the first component of the tamper indication device is a U-shaped housing including a receptacle, and the second component is an extension including a U-shaped end piece and a ratcheted arm that engages the receptacle, attached to one end of the U-shaped end piece. An open end of the U-shaped housing is disposed opposite an open end of the U-shaped end piece of the extension. The alarm device or the actuator, or both, can be disposed within the U-shaped housing. The actuator can be a switch that sets the alarm device when the ratcheted arm is moved in a direction to engage the receptacle, and causes the alarm circuit to generate the alarm signal when the ratcheted arm is moved in a direction to disengage the receptacle.

According to another embodiment, the first component of the tamper indication device is a housing including first and second receptacles, and the second component is an extension including a U-shaped end piece and first and second ratcheted arms that engage the respective first and second receptacles, attached to respective ends of the U-shaped end piece. The housing is disposed between the first and second ratcheted arms and is slidingly attached to the first and second ratcheted arms. The alarm device or the actuator, or both, are disposed within the housing. The actuator can be, for example, a switch that sets the alarm device when the housing is moved along the first and second ratcheted arms in a direction toward the U-shaped end piece, and causes the alarm circuit to generate the alarm signal when the housing is moved along the first and second ratcheted arms in a direction away from the U-shaped end piece.

According to another embodiment, the first component of the tamper indication device is a housing including a receptacle, and the second component is a flexible strap including an extension at a first end that engages the receptacle. The flexible strap can include first attachment means at a second end for attaching the second end to a first surface, and the housing can include second attachment means for attaching the housing to a second surface. The alarm device or the actuator, or both, can be disposed within the housing. The actuator can be, for example, a switch that sets the alarm device when the extension engages the receptacle, and causes the alarm circuit to generate the alarm signal when the extension is disengaged from the receptacle.

According to another embodiment, the first component of the tamper indication device is a housing, and the second component is an extension extending from the housing and attached to the housing such that the extension is rotatable about a central axis of the extension between first and second rotational positions. The housing can be attached to a first surface, such that the extension can engage a bracket attached to a second surface. The alarm device or the actuator, or both, are disposed within the housing. The actuator can be, for example, a switch that sets the alarm device when the extension is disposed in the first rotational position, and causes the alarm circuit to generate the alarm signal when the extension is disposed in the second rotational position.

DETAILED DESCRIPTION OF THE INVENTION

Figure 1:
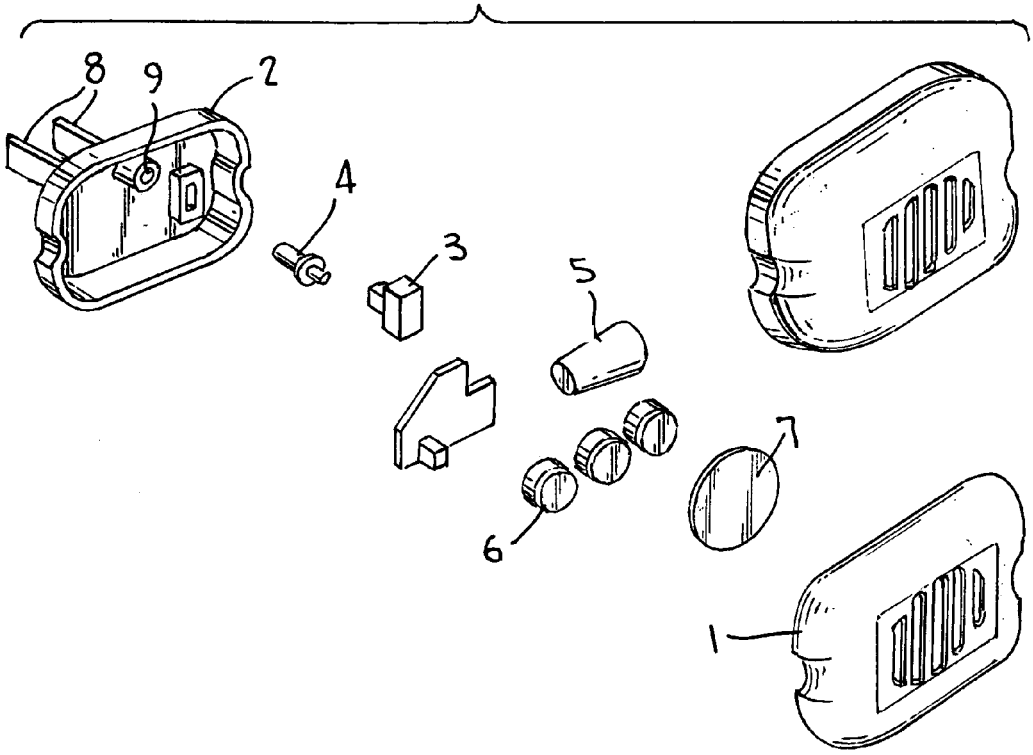
FIG. 1 shows an exemplary embodiment of the present invention, an alarmed cover for an electrical outlet.

FIG. 1 shows an exemplary embodiment of the present invention, an alarmed cover for an electrical outlet. As shown, the outlet cover includes front and back enclosures 1, 2, an actuation switch 3, an alarm switch 4, circuitry 5, a DC power source 6, and a buzzer 7. The circuitry 5 is designed to cause the buzzer 7 to sound under certain conditions. The circuitry 5 is actuated by the actuation switch 3, which, in a positive position, allows the circuitry 5 to determine the condition under which it will cause the buzzer 7 to sound. When the actuation switch 3 is not in the positive position, the buzzer 7 will not sound under any conditions.

Once actuated, the circuitry 5 monitors the position of the alarm switch 4, which is biased in the non-asserted position through an aperture 9 in the back enclosure. When the outlet cover is placed in an electrical socket, the prongs 8 that are part of the back enclosure 2 are inserted into the electrical outlet receptacles. When fully positioned in the socket, the rear face of the back enclosure 2 is substantially flush against the plate or other border surrounding the electrical outlet receptacles, pushing the alarm switch 4 against the bias, through the hole until the alarm switch 4 is flush with the rear face of the back enclosure 2. This position of the alarm switch 4 sets the circuitry 5 to enable the alarm. If the outlet cover is then removed from the receptacle, the biasing mechanism allows the alarm switch 4 to once again protrude through the aperture 9. In this position, the circuitry 5 causes the buzzer 7 to sound. Preferably, the circuitry 5 also includes a timing element that causes a delay between sensing the displacement of the alarm switch 4 with respect to the back enclosure 2 and sounding of the buzzer 7. The buzzer sounds until the actuator switch 3 is turned off.

Thus, the outlet cover shields the electrical receptacle. When the actuation switch 3 is in the positive position, the alarm circuitry 5 is enabled to monitor the alarm switch 4. If the outlet cover is removed from the receptacle, the circuitry 5 senses the relative displacement of the alarm switch 4 with respect to the back enclosure 2, causing the buzzer 7 to sound, preferably after a delay.

Figure 2:
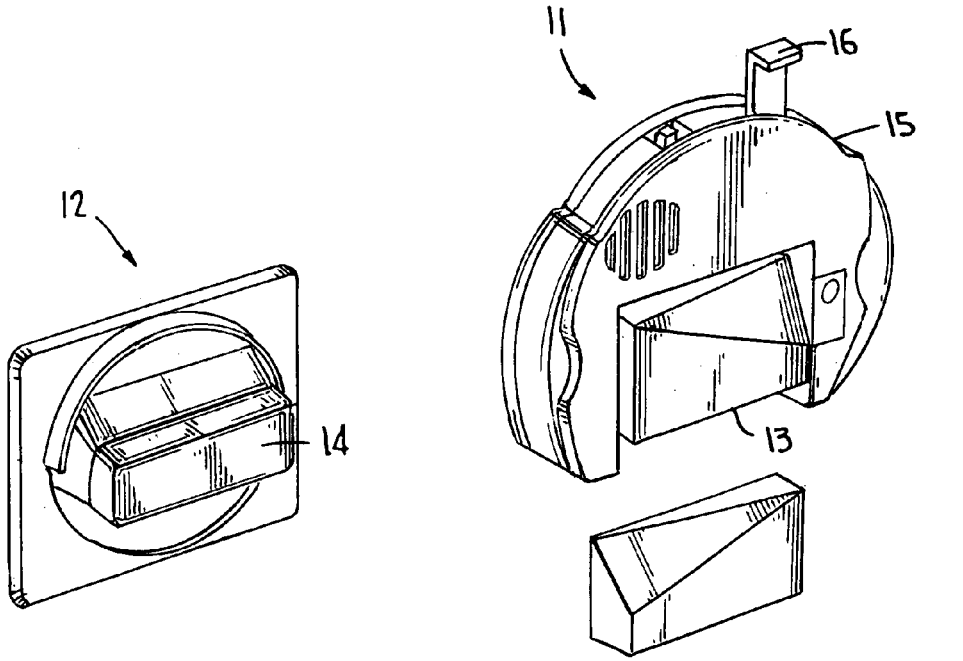
FIG. 2 shows an exemplary embodiment of the present invention, an alarmed sliding door lock.

FIG. 2 shows another exemplary embodiment of the present invention, an alarmed sliding door lock. As shown, the door lock includes a first component 11 and a second component 12, each of which is attached to a different side of a sliding door, such as a glass patio door. The components 11, 12 can be attached to the door, for example through the use of an adhesive applied to the appropriate surfaces of the components 11, 12. The base 15 of the first component 11 is thin enough so that, when it is attached to the first panel of a sliding door, the second panel of the door can slide over the first component 11, allowing the door to be opened. The first component 11 includes a lock block 13 that is pivotally attached to the first component 11. The second component 12 includes a rotary switch 14. The lock block 13 and the rotary switch 14 include opposing magnets, the relative position of which changes when the rotary switch 14 is turned. When the rotary switch 14 is in a first position, the lock block 13 is also in a first position with respect to the pivot axis of the lock block 13. When the rotary switch 14 is rotated into the second position, the lock block 13 is caused to pivot about the pivot axis by the movement of the rotary switch magnet.

When in the first position, the lock block 13 is oriented such that it prevents a second panel of the door to slide across it, effectively locking the door. When in the second position, the pivoted lock block 13 allows passage of the second panel of the door. For example, the outer surface of the lock block 13 can be tapered as shown in the exemplary embodiment. In the first position, the end of the lock block 13 facing the second panel of the door sticks out from the base of the lock, in a position to abut the second panel when the second panel is slid toward the lock block 13. In the second position, the lock block 13 is pivoted such that the end of the lock block 13 substantially aligns with the surface of the lock base 15, allowing the second panel to pass.

Preferably, the rotary switch 14 is biased, such as by a spring, to maintain the rotary switch 14 in the first position unless someone actively turns the switch 14 to the second position. Thus, the lock block 13 remains in the locked position under normal circumstances. As shown, it is also preferable that the lock block 13 is removable for reassembly in a position that is rotated by 180 degrees with respect to the pivot axis, to allow the lock block 13 to be configured for second door panels that slide from either the left or the right of the door lock.

The first component includes a lock bar 16. When in an unlocked position, the lock bar 16 is disposed such that it is clear of the lock block 13, and the alarmed sliding door lock operates as described above. When the lock bar 16 is in a locked position, the lock bar 16 prevents the lock block 13 from pivoting on the pivot axis, and keeps the lock block 13 in the locked position. Thus, when the lock bar 16 is in the locked position, turning the rotary switch 14 will not move the lock block 13, which will prevent the sliding door from being opened. As shown, the lock bar 16 can be a flat, rigid member that slides within an internal channel of the base 15 of the first component 11, between the unlocked and locked positions. The lock bar 16 can include an offset end for ease of returning the lock bar 16 to the unlocked position.

The sliding door lock can include an alarm device, such as dedicated internal circuitry within the base 15 of the first component 11, that sounds an alarm when the rotary switch is turned to unlock the door. Alternatively, the alarm sounds when the lock bar is moved from the locked position to the unlocked position. In either case, it is preferable that the sliding door lock include an alarm actuation switch. When this switch is in an active position, the alarm feature described above is enabled. When this switch is in an inactive position, the alarm feature is disabled.

Figure 3:
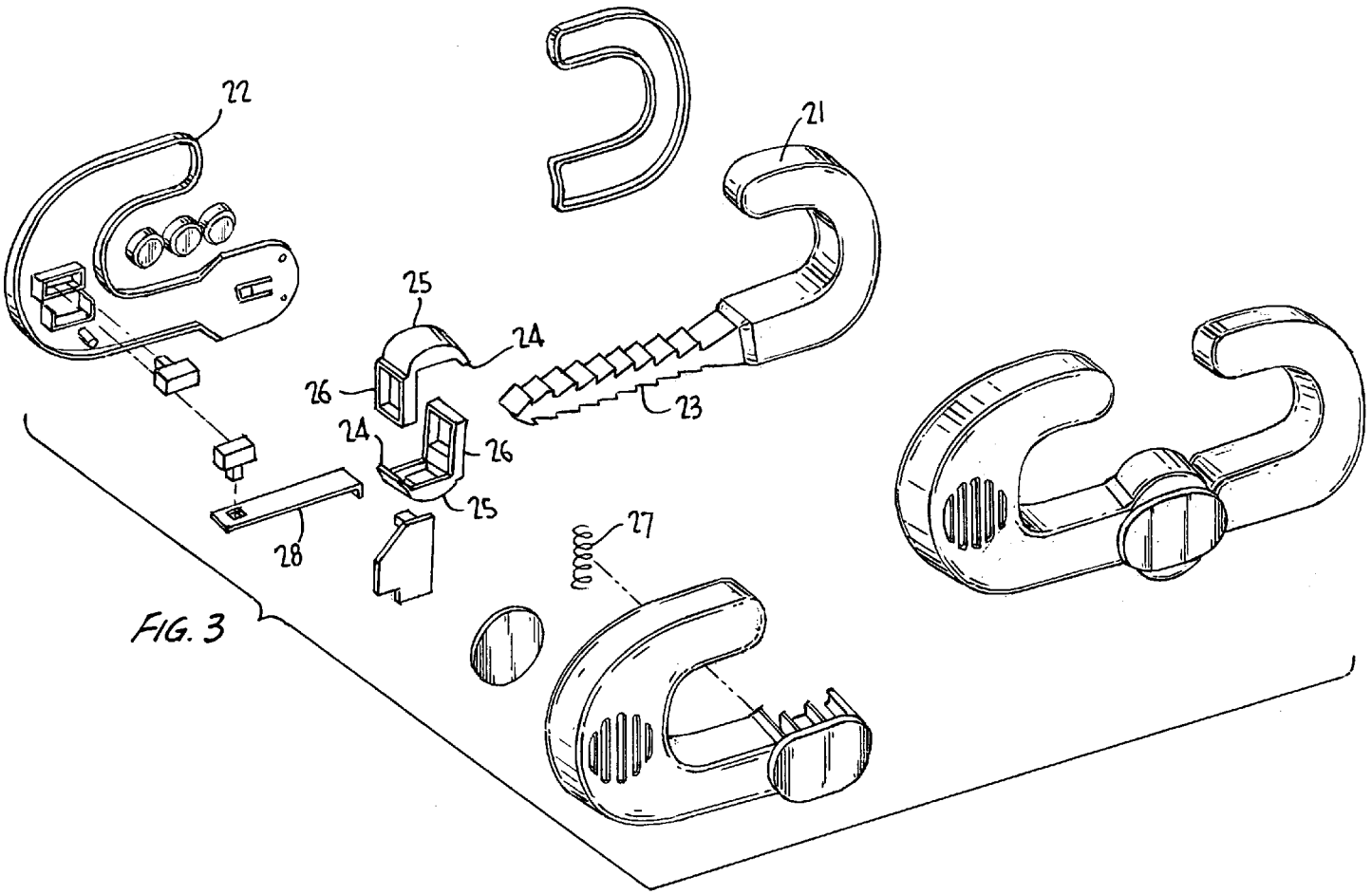
FIG. 3 shows another exemplary embodiment of the invention, an alarmed cabinet door lock.

FIG. 3 shows another exemplary embodiment of the invention, a cabinet door lock, for use with cabinets of the type that have double doors that swing outward from a center line, with door handles or knobs toward the center line. The cabinet door lock includes a first hook 21 and a second hook 22, which engage the door handles. The first hook 2 includes an extension 23 that engages a channel in the second hook 22, such that the first hook 21 can move in a reciprocating fashion with respect to the second hook 22. The extension 23 includes teeth that engage one or more corresponding teeth in a central lock module. For example, as shown, the extension 23 can include teeth on both sides, which engage upper and lower prongs 24 that are biased against the teeth. The prongs 24 are attached to first ends of upper and lower unlock buttons 25. Upper and lower unlock extensions 26 are attached to the second ends of the unlock buttons 25. The unlock extensions 26 include apertures through which the extension 23 passes. The teeth on the extension 23 are angled such that the prongs 24 do not resist reciprocal motion of the extension 23 when the hooks 21, 22 are moved toward each other, but resist motion that would move the hooks 21, 22 apart. When the unlock buttons 25 are pressed toward each other (against a bias provided, for example, by a spring 27), the unlock extensions 26 press against the respective prongs 24 of the opposing unlock button, against the bias that presses the prongs 24 against the teeth, removing the resistance to motion of the extension 23 and allowing the hooks 21, 22 to be moved away from each other. Thus, the hooks 21, 22 can engage the cabinet door handles, and can be moved toward each other until the hooks maintain a tight squeeze on the handles. In this position, the cabinet cannot be opened because the handles are prevented from swinging apart with the doors. This locking grip on the cabinet door handles can only be released by squeezing the unlock buttons 25 so as to disengage the prongs 24, allowing the hooks 21, 22 to be pulled apart and removed from the door handles.

This exemplary embodiment also includes an alarm device, preferably disposed within the second hook 22, which alerts an observer that the lock cabinet door lock has been unlocked and/or removed. Preferably, this feature does not function unless first actuated by movement of an actuation switch. After actuation, the cabinet door lock is put into place on the cabinet door handles. Subsequently, when the unlock buttons 25 are pressed, an alarm sounds to notify people in the vicinity that the lock has been unlocked. Alternatively, the motion of pulling the hooks 21, 22 apart sounds the alarm. In any case, there might be a delay between the activating motion and sounding of the alarm. The alarm can be provided by circuitry disposed within the body of the cabinet door lock. For example, a lever 28 having an offset end can be applied against the extension teeth or against a prong 24. Motion of the teeth or prong can activate circuitry disposed at the other end of the lever 28, causing the alarm to sound.

Figure 4:
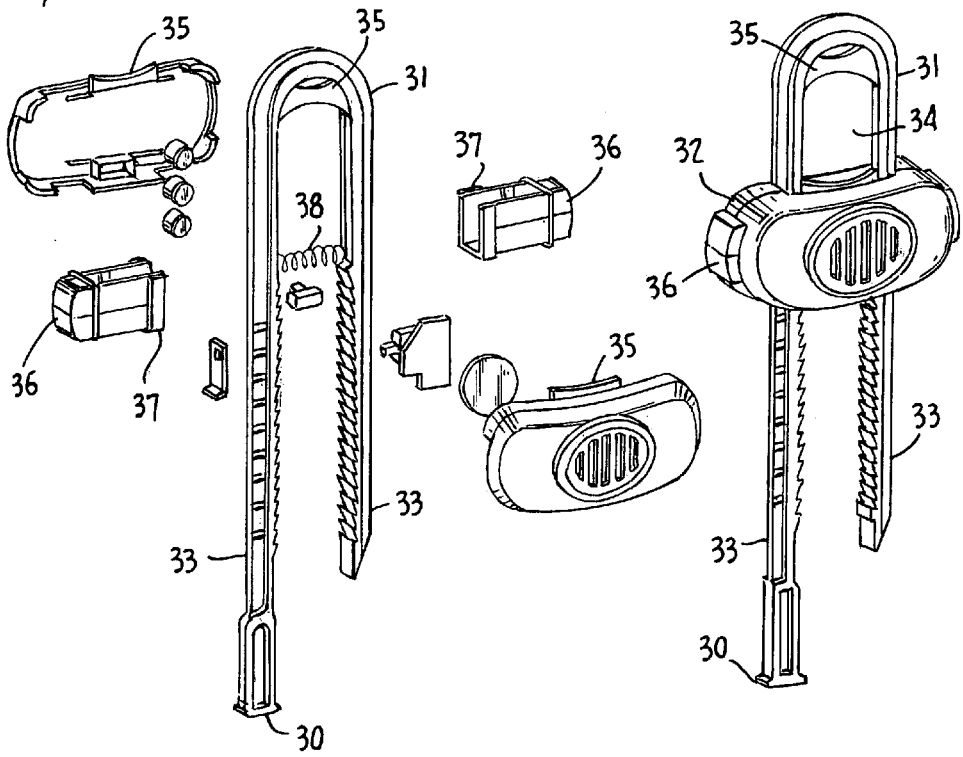
FIG. 4 shows another exemplary embodiment of the invention, an alarmed cabinet lock.

FIG. 4 shows another exemplary embodiment of the invention, an alternative cabinet lock. Instead of opposing hooks, this lock uses a sliding U-shaped yoke 31 to retain the cabinet door handles. Thus, this embodiment of the lock is useful for locking cabinets that have handles with apertures, although it can also be used to enclose handles having a tapered-outward shape. The yoke 31 passes through a base module 32, which houses alarm circuitry. The base module 32 includes two receptacles, which receive respective ratcheted arms 33 of the U-shaped yoke 31, defining an enclosed area 34 that can be constricted by sliding the ratcheted arms 33 farther through the base module 32, and enlarged by sliding the ratcheted arms 33 back out of the base module 32. Preferably, an end 30 of at least one of the ratcheted arms 33 is shaped such that it cannot pass completely through the receptacle in the base module 32, so that the yoke 31 cannot be completely removed from the base module 32.

When the enclosed area 34 defined by the yoke 31 and the base module 32 is disposed around cabinet door knobs and constricted by sliding the base module 32 along the ratcheted arms 33, the cabinet doors are prevented from opening. The base module 32 preferably includes curved portions 35 on the U-shaped end of the yoke 31 and on the facing portion of the base module 32 in order to provide a closer fit against the cabinet door handles. The ratcheted arms 33 include ratchet teeth that communicate with corresponding teeth inside the base module 32 such that opening of the restricting area 34 is prevented. In order to allow unlocking of the cabinet doors, the base module 32 includes opposing unlock buttons 36 that have extensions 37 that press against outer edges of the ratchet arms 33. When the unlock buttons 36 are pressed toward each other, the extensions 37 press against the ratchet arms 33 so as to move the ratchet arms 33 apart enough to disengage the ratchet arm teeth from the corresponding teeth in the base module 32. Once the ratchet teeth are disengaged, one can slide the yoke 31 through the base module 32 to loosen the lock and unlock the cabinet. The base module 32 preferably includes biasing means, such as a spring 38 (shown in the exploded view of FIG. 4 in its operative position between the ratchet arms 33), that engages the ratchet arms 33 and pulls the ratchet arms 33 together.

The base module 32 also includes alarm circuitry that indicates when the cabinet lock is unlocked or removed. This alarm can sound when the unlock buttons 36 are pressed together, or when the base module 32 is moved away from the U-shaped end of the yoke 31. A time delay can be set between the enabling action and the sounding of the alarm. Preferably, the alarm feature includes an actuator that can be set through the use of a simple switch. Once the alarm is actuated, it is set to function as described. When not actuated, the lock can be unlocked and removed without sounding the alarm.

Figure 5:
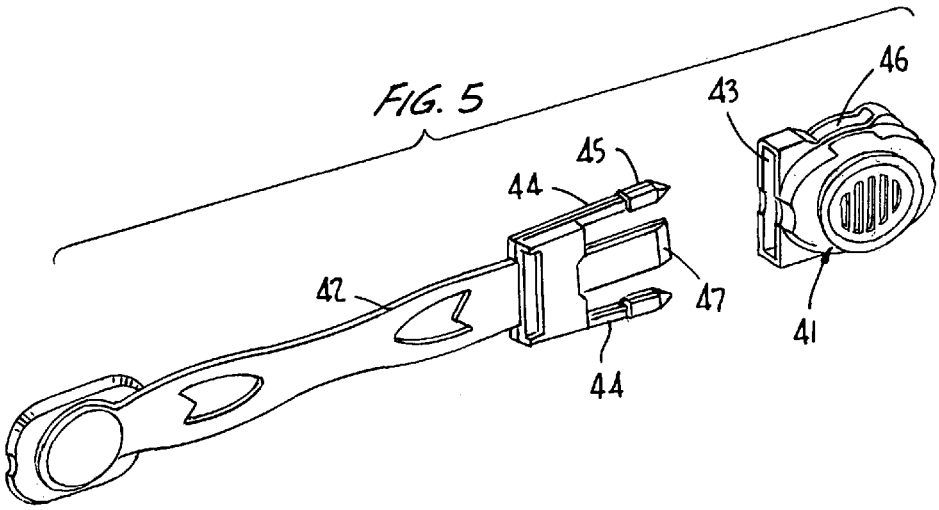
FIG. 5 shows another exemplary embodiment of the invention, an alarmed flexible strap lock.

FIG. 5 shows another exemplary embodiment of the invention, a lock for an appliance door, or any other type of swinging door that doesn't necessarily have opposing handles, or requires a locking mechanism that provides flexibility in set up and operation due to the configuration of the door. This lock includes a housing 41 and a flexible strap 42. The housing 41 includes a receptacle 43, and the strap 42 includes one or more extensions 44 at a first end that engages the receptacle 43. Protrusions 45 on the extension mate with corresponding features in the receptacle 43 to provide a click fit. Portions of the protrusions 45 are accessible through gaps 46 in the housing 41. When these portions are pressed together, the protrusions 45 on the extension 44 are released from the receptacle 43, and the strap 42 can be disengaged from the housing 41.

The flexible strap 42 includes adhesive or other attachment means at the end opposite the extension for attaching that end to a surface. The housing 41 also includes adhesive or other attachment means so that the housing 41 can be attached to another surface. For example, an appliance such as a refrigerator has a door on the front of the appliance that swings outward from the front surface. The outside swinging edge of the door normally is flush with the side edge of the refrigerator when the door is closed. For use on such an appliance, the housing 41 can be attached to the door of the appliance, and the strap 42 can be attached to the side of the appliance adjacent the swinging door edge. When the extension 44 is engaged in the receptacle 43, the door is prevented from opening. Placement of the attachment end of the strap 42 and of the housing 41 will determine the amount of slack in the locked apparatus.

The housing 41 also includes alarm circuitry that indicates when the lock is unlocked or removed. This alarm can sound when the unlocking extension portions are pressed together, or when the extension 44 is disengaged from the receptacle 43. A time delay can be set between the enabling action and the sounding of the alarm. Preferably, the alarm feature includes an actuator that can be set through the use of a simple switch. Once the alarm is actuated, it is set to function as described. When not actuated, the lock can be unlocked and removed without sounding the alarm. Alternatively, the alarm function can be automatically actuated when the extension 44 fully engages the receptacle. For example, an actuator bar 47 can be disposed between two extensions 44, to engage an actuation switch within the receptacle 43 when the extensions 44 are locked into place.

Figure 6:
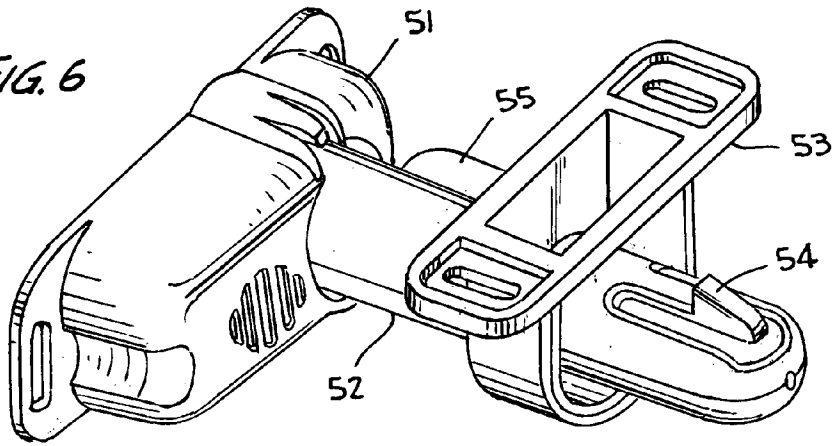
FIG. 6 shows another exemplary embodiment of the invention, an alarmed sliding drawer lock.

FIG. 6 shows another exemplary embodiment of the invention, a sliding drawer lock. The sliding drawer lock includes a housing 51 and an extension 52 extending from the housing 51 and attached to the housing 51 such that the extension 52 is rotatable about a central axis of the extension 52 between first and second rotational positions. The housing 51 is attached to a first surface, such that the extension can engage a bracket 53 attached to a second surface. For example, the housing 51 can be attached to the inside front panel of a sliding drawer, and the bracket 53 can be attached to the bottom surface of a component of the drawer frame, such as the underside of a cabinet top if the top drawer is to be locked. The extension 52 includes an angled protrusion 54 that is biased outwardly from the extension 52.

When the extension 52 is inserted into the bracket 53, the slope of the angled protrusion 54 enters the aperture of the bracket 53 first, and abuts a latching wall on the bracket 53. As force is applied to push the extension 52 farther through the bracket 53, this force overcomes the bias force on the angled protrusion 54 such that the protrusion 54 depresses into the extension 52. Once the extension 52 is inserted into the bracket 53 past the trailing edge of the protrusion 54, the bias pushes the protrusion 54 back outward. If an attempt is made to remove the extension 52 from the bracket 53, the protrusion 54 abuts the latching wall, and further progress is prevented. If the extension 52 is rotated about its central axis, the protrusion 54 is also rotated out of range of the latching wall, and the extension 52 can be removed. Preferably, the extension 52 includes a ledge 55 on the outside periphery of the extension 52 to facilitate rotation of the extension 52. The extension 52 is also preferably biased to rotate back into the locked position once the rotational force is released.

When the lock is attached to the drawer and frame, the abutment of the angled protrusion 54 against the latching wall prevents complete opening of the drawer. However, enough space should be allowed along the length of the extension 52 between the abutting edge of the protrusion 54 and the latching wall when the drawer is fully closed so that the drawer can be opened partially, enough for an adult to insert a finger into the drawer to push down on the ledge 55, rotate the extension 52, and unlock the drawer.

The housing 51 also includes alarm circuitry that indicates when the lock is unlocked or the drawer is opened. This alarm can sound when the extension 52 is rotated into the unlock position, or when the extension 52 rotates back into the locked position after the drawer has been opened. A time delay can be set between the enabling action and the sounding of the alarm. Preferably, the alarm feature includes an actuator that can be set through the use of a simple switch. Once the alarm is actuated, it is set to function as described. When not actuated, the lock can be unlocked and removed without sounding the alarm. Alternatively, the alarm function can be automatically actuated when the extension 52 fully engages the bracket 53, such as by the depressing motion of the protrusion beyond the latching wall.

Figure 7:
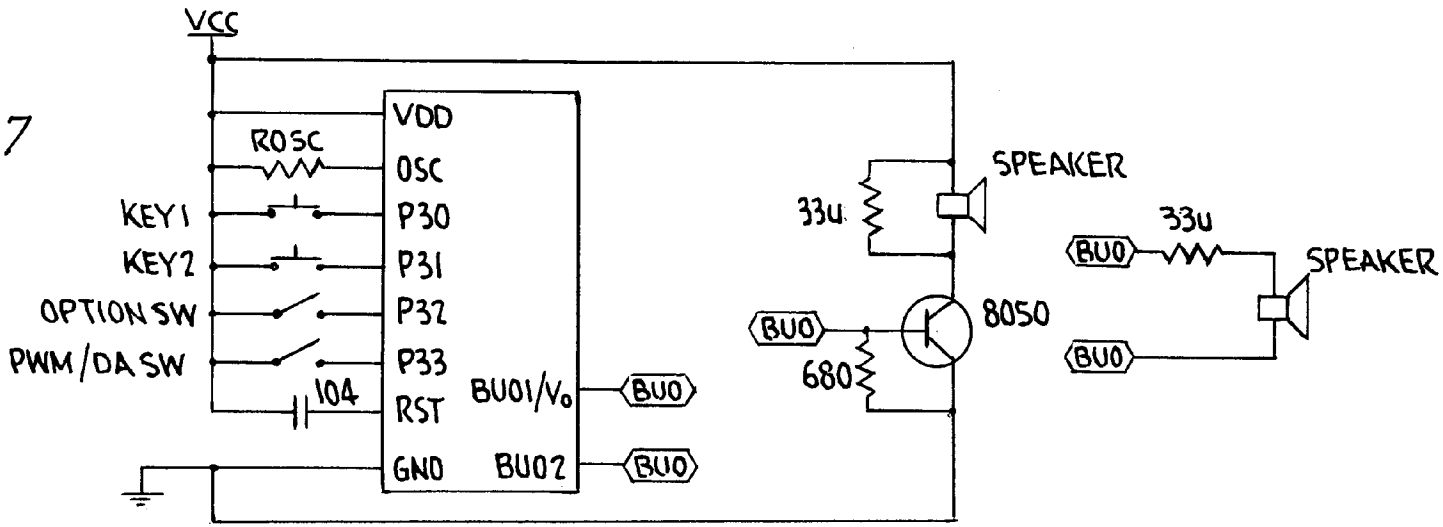
FIG. 7 shows an exemplary switching circuit for use with the alarm of the present invention.

FIG. 7 shows an exemplary switching circuit for use with the alarm of the present invention. In this exemplary circuit, an integrated switching circuit SW04281, SW04343, or the like can be used. The hard switch represented by Option SW is the actuation switch that allows the alarm function to be set. Key1 and Key2 are momentary switches that control the voltage outputs BUO1/Vo and BUO2. PWM/DA SW is another actuation switch that sets other conditions in the IC. When Option SW is in the open position, the position of Key1 has no effect on the alarm circuit. When Option SW is in the closed position, the position of Key1 controls the action of the alarm circuit. The designer has the option of selecting which action will put a positive voltage on the line BUO1 in order to turn on the transistor 8050 and sound the alarm speaker. That is, momentary depression of the Key1 switch can be set as the condition to sound the alarm, or release of the Key1 switch after momentary depression can be the alarm condition.

The designer can also set use of a delay. For example, if the PWM/DA SW switch is open, no delay function is set; if this switch is closed, an alarm delay will be programmed. The PWM/DA SW switch can be settable by a user, or can be hard-wired open or closed at manufacture. When the delay option is set, Key1 and Key2 are wired in parallel, so that they are depressed together when the alarm-sounding condition exists, and both keys are required to be depressed in order to sound the alarm. However, the effect of depressing the Key2 switch is delayed by the IC, and therefore if the alarm condition still is not present after the delay has passed, the alarm will not sound. For example, if the IC is set for a 10-second delay, the alarm circuit will not recognize depression of both keys until a 10 second delay has passed. If the condition is still present after 10 seconds, the alarm will sound; if the condition does not last at least 10 seconds, the alarm will not sound. It will be recognized by those of skill in the art that other circuits, ICs and designs can be used to achieve the same or similar end result, and that common, off-the-shelf circuits or specialty designs realized on custom PCBs can be used.

I claim:

1. A tamper indication device, comprising:

a first component;

a second component;

an alarm device, wherein the alarm device indicates relative displacement of the first component and the second component; and an alarm suppression device that prevents setting of the alarm device if actuated during a fixed time period.

2. The device of claim 1, wherein the alarm device includes an alarm circuit that detects the relative displacement and generates an alarm signal; and an alarm indicator that receives the alarm signal and generates an alarm indication.

3. The device of claim 2, wherein the alarm indicator is an audio speaker.

4. The device of claim 2, further comprising an actuator that sets the alarm device.

5. The device of claim 4, wherein the actuator includes a switch.

6. The device of claim 5, wherein the switch has a first position and a second position.

7. The device of claim 6, wherein the actuator sets the alarm device when the switch is moved to the first position.

8. The device of claim 7, wherein the alarm indicator indicates an alarm when the switch is moved from the first position to the second position after the alarm device has been set.

9. The device of claim 4, wherein the actuator includes a latch.

10. The device of claim 4, wherein the alarm device includes a delay device that delays the setting of the alarm device by a fixed time period following actuation of the alarm device by the actuator.

11. The device of claim 10, wherein the delay device is a circuit that senses actuation of the alarm device by the actuator and delays the setting of the alarm device by the fixed time period.

12. The device of claim 10, wherein the fixed time period is adjustable.

13. The device of claim 2, wherein the first component is a blocking device attached to a first side of a sliding door, and the second component is a knob attached to a second side of a sliding door, opposite the blocking device.

14. The device of claim 13, wherein the blocking device includes a housing and a block within the housing that is movable between a first block position and a second block position.

15. The device of claim 14, wherein the block is attached to the housing along an axis, and the block is rotatable about the axis between the first block position and the second block position.

16. The device of claim 14, wherein the block prevents the sliding door from opening when the block is in the first block position, and the block allows the sliding door to open when the block is in the second block position.

17. The device of claim 16, wherein the knob is rotatable between a first knob position and a second knob position.

18. The device of claim 17, wherein the disposition of the knob in the first knob position causes the block to be disposed in the first block position, and disposition of the knob in the second knob position causes the block to be disposed in the second knob position.

19. The device of claim 18, wherein the knob includes a first magnet and the block includes a second magnet, wherein the relative positions of the first and second magnets control whether the block is disposed in the first or second block position.

20. The device of claim 16, wherein the alarm circuit is disposed in the blocking device housing.

21. The device of claim 20, wherein the alarm circuit includes a switch.

22. The device of claim 21, wherein the switch is movable between a first switch position and a second switch position.

23. The device of claim 22, wherein the alarm circuit generates the alarm signal when the switch is disposed in the second switch position.

24. The device of claim 23, wherein the alarm circuit continuously generates the alarm signal after the switch has been disposed in the second switch position.

25. The device of claim 22, wherein the block causes the switch to be disposed in the second switch position when the block is disposed in the second block position.

26. The device of claim 15, wherein the blocking device further includes a bar that is slidable between a first bar position and a second bar position.

27. The device of claim 26, wherein the bar allows the block to be moved to the second block position when the bar is disposed in the first bar position, and the bar prevents the block from being moved to the second block position when the bar is disposed in the second bar position.

28. The device of claim 8, wherein the first component is a U-shaped housing including a receptacle, and the second component is an extension including a U-shaped end piece and a ratcheted arm that engages the receptacle, attached to one end of the U-shaped end piece.

29. The device of claim 28, wherein an open end of the U-shaped housing is disposed opposite an open end of the U-shaped end piece of the extension.

30. The device of claim 28, wherein the alarm device is disposed within the U-shaped housing.

31. The device of claim 30, wherein the actuator is disposed within the U-shaped housing.

32. The device of claim 31, wherein the actuator is a switch that sets the alarm device when the ratcheted arm is moved in a direction to engage the receptacle, and causes the alarm circuit to generate the alarm signal when the ratcheted arm is moved in a direction to disengage the receptacle.

33. The device of claim 8, wherein the first component is a housing including first and second receptacles, and the second component is an extension including a U-shaped end piece and first and second ratcheted arms that engage the respective first and second receptacles, attached to respective ends of the U-shaped end piece.

34. The device of claim 33, wherein the housing is disposed between the first and second ratcheted arms and is slidingly attached to the first and second ratcheted arms.

35. The device of claim 33, wherein the alarm device is disposed within the housing.

36. The device of claim 35, wherein the actuator is disposed within the housing.

37. The device of claim 36, wherein the actuator is a switch that sets the alarm device when the housing is moved along the first and second ratcheted arms in a direction toward the U-shaped end piece, and causes the alarm circuit to generate the alarm signal when the housing is moved along the first and second ratcheted arms in a direction away from the U-shaped end piece.

38. The device of claim 8, wherein the first component is a housing including a receptacle, and the second component is a flexible strap including an extension at a first end that engages the receptacle.

39. The device of claim 38, wherein the flexible strap includes first attachment means at a second end for attaching the second end to a first surface, and the housing includes second attachment means for attaching the housing to a second surface.

40. The device of claim 39, wherein the alarm device is disposed within the housing.

41. The device of claim 40, wherein the actuator is disposed within the housing.

42. The device of claim 41, wherein the actuator is a switch that sets the alarm device when the extension engages the receptacle, and causes the alarm circuit to generate the alarm signal when the extension is disengaged from the receptacle.

43. The device of claim 8, wherein the first component is a housing, and the second component is an extension extending from the housing and attached to the housing such that the extension is rotatable about a central axis of the extension between first and second rotational positions.

44. The device of claim 43, wherein the housing is attached to a first surface, and the extension engages a bracket attached to a second surface.

45. The device of claim 43, wherein the alarm device is disposed within the housing.

46. The device of claim 45, wherein the actuator is disposed within the housing.

47. The device of claim 46, wherein the actuator is a switch that sets the alarm device when the extension is disposed in the first rotational position, and causes the alarm circuit to generate the alarm signal when the extension is disposed in the second rotational position.

48. The device of claim 8, wherein the first component is an electrical socket base, and the second component is an electrical outlet socket cover.

49. The device of claim 48, wherein the electrical outlet socket cover includes at least one prong that engages a receptacle of the electrical socket.

50. The device of claim 48, wherein the alarm device is disposed within the electrical outlet socket cover.

51. The device of claim 50, wherein the actuator is disposed within the electrical outlet socket cover.

52. The device of claim 51, wherein the switch is moved to the first position when the electrical outlet socket cover is disposed against the electrical socket base, and the switch is moved to the second position when the electrical outlet socket cover is moved away from the electrical socket base.

* * * * *